United States Patent [19]

Alexander et al.

[11] 3,957,529

[45] May 18, 1976

[54] METHOD FOR CLEANING AND PASSIVATING A METAL SURFACE

[75] Inventors: George B. Alexander; Norman F. Carpenter, both of Tulsa, Okla.

[73] Assignee: The Dow Chemical Company, Midland, Mich.

[22] Filed: June 3, 1974

[21] Appl. No.: 475,704

Related U.S. Application Data

[62] Division of Ser. No. 324,651, Jan. 18, 1973.

[52] U.S. Cl. ..... 134/3; 134/28; 134/40; 134/41

[51] Int. Cl.[2] ..... C23G 1/02

[58] Field of Search ..... 252/143, 146, 170, 87, 252/DIG. 1; 134/3, 28, 40, 41

[56] References Cited

UNITED STATES PATENTS

| | | | |
|---|---|---|---|
| 2,994,664 | 8/1961 | Wachter | 252/146 X |
| 3,114,657 | 12/1963 | Stilwell | 134/28 |
| 3,162,547 | 12/1964 | Kendall | 134/28 X |
| 3,239,467 | 3/1966 | Lipinski | 252/143 X |
| 3,330,769 | 7/1967 | Golben et al. | 252/143 X |
| 3,522,093 | 7/1970 | Woolman | 134/28 X |

*Primary Examiner*—S. Leon Bashore
*Assistant Examiner*—Marc L. Caroff
*Attorney, Agent, or Firm*—Stephen R. Wright

[57] ABSTRACT

A cleaning solvent useful in the cleaning of metal surfaces, e.g. nickle-iron alloys, contains sulfamic acid, citric acid, a solvent for hydrocarbon residues, and a surfactant. Metal surfaces are cleaned by contacting the surface with the cleaning solvent and then passivated by contact with aqueous solutions of citric acid or sodium nitrite or a combination of the two.

10 Claims, No Drawings

METHOD FOR CLEANING AND PASSIVATING A METAL SURFACE

The invention described herein was made in the performance of work under a NASA contract and is subject to the provisions of section 305 of the National Aeronautics and Space Act of 1958, Public Law 85–568 (72 Stat. 435; 42 U.S.C. 2457).

This is a division of application Ser. No. 324,651 filed Jan. 18, 1973.

BACKGROUND OF THE INVENTION

The invention relates generally to the cleaning of metal surfaces. More specifically, the invention pertains to a composition useful for the dynamic cleaning of such metals as Invar alloy, which is a nickel-iron alloy especially suited for cryogenic temperatures because of its low thermal expansivity. A representative sample of this alloy contains the following elements by weight percent:

| | |
|---|---|
| Iron | 61.4 – 64.4 |
| Nickel | 34.5 – 36.5 |
| Cobalt | 0.50 |
| Titanium | 0.30 –0.60 |
| Manganese | 0.30 –0.60 |
| Silicon | ≤ 0.30 |
| Carbon | ≤ 0.05 |
| Phosphorus | ≤ 0.015 |
| Sulfur | ≤ 0.015 |
| Lead | ≤ 0.015 |
| Tin | ≤ 0.015 |
| Selenium | ≤ 0.010 |

Cleaning alloys for use in cryogenic applications, such as piping for extremely low temperature fuel and oxidizer systems in rockets and spacecraft presents difficult problems: for example, the systems must be devoid of all hydrocarbon and particulate contamination. Conventional cleaning solvents are not satisfactory for the present purpose.

Although acids such as phosphoric, sulfuric, and hydrochloric display low corrosion rates, they produce objectionable smut on the metal surface. Smut is defined as the accumulation of noticeable amounts of nonadsorbent products on chemically treated metal surfaces, usually resulting from cleaning or etching. Use of oxidizing agents in conjunction with acids increases corrosion rates without lessening the smut formation. Although the nickel-iron alloys have good corrosion resistance to caustic solutions at ambient temperature, effective cleaning and degreasing with alkaline solutions requires elevated temperatures, where corrosion rates become objectionable.

Consequently there is a need for a cleaning solvent which satisfactorily descales, cleans, and degreases metal surfaces, particularly iron-nickel surfaces, without leaving smut or causing excessive corrosion.

SUMMARY OF THE INVENTION

The present composition produces minimum corrosive effect while effectively removing hydrocarbon residue and particulate matter from a metal surface. The composition is an aqueous solution of sulfamic acid, citric acid, a solvent for hydrocarbon residues, e.g., 2-butoxyethanol, and a surfactant. A dynamic cleaning procedure involves flowing this composition over a metal surface to be cleaned at a flow rate and in an amount sufficient to clean the metal surface.

DETAILED DESCRIPTION OF THE INVENTION

The composition may be prepared by mixing any or all of the ingredients together and then adding water or by adding the ingredients one at a time to water. All percentages hereafter mentioned are to be taken as weight percentages unless otherwise indicated. The sulfamic acid should be present in an amount between 8 to 12 percent (%) of the aqueous solution, preferably 10%. The citric acid should be present in an amount between 4 to 6% of the aqueous solution, preferably 5%.

The solvent for hydrocarbon residues is a substance capable of dissolving hydrocarbon residues, e.g. greases, waxes or oils, present on the metal surface or created during the cleaning. Included within our use of the term "solvent" are those substances popularly termed "degreasers," however, the present solvents will in addition dissolve certain residual organic contaminants not properly defined as greases.

Such solvent must be soluble in and nonreactive with the acid cleaning solution as well as being capable of dissolving hydrocarbon residues. The solvent may be any nonionic material which at the concentration used in the present acid cleaning solution and at a temperature of 75°F. will give a clear solution having substantially no turbidity. Representative solvents include, for example, glycol ethers such as 2-butoxyethanol, 2(2-butoxyethoxyl)ethanol, 2-(ethoxyethoxy)ethanol, 2-methoxyethanol, and 2-ethoxyethanol. The solvent should be present in an amount between 4 and 6% of the aqueous cleaning solution, preferably 5%.

The surfactant serves as a wetting agent, i.e., it lowers the surface tension of the water, and emulsifies and helps to remove hydrocarbon residues. Any nonionic surfactant which has a cloud point in excess of about 90°F. and which at a concentration of 0.1% in the present acid cleaning solution has a surface tension of about 32 dynes/cm. or less is usable. Cloud point is the temperature at which the surfactant becomes insoluble in the composition. Representative substances include linear alcohol ethoxylates, polyoxyethylene esters, and alkyl aryl polyethylene oxides. An especially useful surfactant comprises a mixture of primary alcohols with 10–12 atoms carbon chains, 60% ethoxylated. The surfactant should be present in an amount between 0.095 and 0.15% of the aqueous mixture, preferably 0.1%.

The present composition is useful in cleaning metal surfaces in general. It is particularly useful in the cleaning of iron-nickel alloys, carbon steel, and titanium.

The composition will satisfactorily clean metal surfaces at ambient temperatures. At lower temperatures excessive time is required and cleaning is less efficient. Higher temperatures usually ease the cleaning but may cause objectional corrosion rates. Operating temperatures within the range of about 40° to 140°F. are feasible for the use of the present cleaning solution; the preferred operating temperatures are within the range of about 70°–80°F.

It is found that although the present composition is useful in cleaning metal surfaces in static applications, it is particularly useful in dynamic cleaning techniques, such as cleansing the interior of a pipe by passing the cleaning solvent through the pipe. In such applications, it is important to choose an appropriate flow rate. This rate depends on the pipe size and the degree of cleaning required. Higher flow rates are found to induce greater turbulence at the metal surface which allows the solvent to pick up occluded particles. Thus, removal of particulate contamination to leave only a very small residue will require higher flow rates. For example, an iron-nickel alloy pipe was satisfactorily cleaned, i.e., the contamination was reduced from about 76 mg. of triolein and mineral oil per square foot of surface to about 0.027 mg. per square foot, by flowing a composition comprising 10% sulfamic acid, 5% citric acid, 5% 2-butoxyethanol and 0.1% of a mixture of primary alcohols (60% ethoxylated) through the pipe at a rate of 5.5 feet per second. For various materials, including nickel-iron alloys, flow rates may be chosen by practioners of this invention to effect the desired degree of cleaning based on the parameters present. A representative range of rates is from 2 to about 30 feet per second; on iron-nickel alloys the preferred rate is 4 feet per second.

The length of time over which the flow is continued depends on the amount of contaminant desired to be removed and the amount of corrosion of the metal surface which is tolerable. Corrosion incurred in turn depends, inter alia, on flow rate. Thus, more complete cleaning and higher flow rates cause greater corrosion of the surfaces. An iron-nickel alloy pipe contaminated with triolein and mineral oil in a density of from about 0.04 to about 0.08 grams per square inch was preferably cleaned for 2 hours at a cleaning solvent flow rate of 4 ft./sec., for 6 hours at 2 ft./sec., and for 0.5 hour at 30 ft./sec.

It is desirable to follow the cleaning flow with a water flush to remove residual cleaning solution. With some surfaces it is also desirable to use a passivation flush, utilizing, for example, aqueous solutions of citric acid or sodium nitrite or a combination of the two. The passivation flush renders the metal surface less susceptible to oxidation. For example, a newly cleaned iron-nickel alloy was passivated by flowing a 1% citric acid solution over the surface at 5.5 ft./sec. for 10 min., followed by a flow of 0.1% aqueous sodium nitrite solution at 5.5 ft./sec. for 10 min. Thereafter, the surface was rinsed with a 20 min. flow of water at a rate of 3.5 ft./sec.

In the following examples cleaning mixtures comprising various proportions of ingredients were tested in static and dynamic cleaning applications.

EXAMPLE 1

Herein iron nickel alloy coupons of size 4.6 × 2.5 × 0.3 cm. were first contaminated with a hydrocarbon residue consisting of triolein and mineral oil and particulate matter consisting of polystyrene spheres of 20–200 micron size. The coupons were immersed in the cleaning solution which was maintained at ambient temperature (about 60°–80°F.). The solution was stirred with a magnetic stirrer to create a vortex and thus to introduce air into the liquid. The amount of metal lost by corrosion and the depth of corrosion penetration were measured, and the cleaning effectiveness was evaluated visually. The results of these tests are tabulated in Table I.

The iron nickel alloy contained the following in weight percent:

| | |
|---|---|
| Iron | 61.4 – 64.4 |
| Nickel | 34.5 – 36.5 |
| Cobalt | 0.50 |
| Titanium | 0.30 –0.60 |
| Manganese | 0.30 –0.60 |
| Silicon | ≦ 0.30 |
| Carbon | ≦ 0.05 |
| Phosphorus | ≦ 0.015 |
| Sulfur | ≦ 0.015 |
| Lead | ≦ 0.015 |
| Tin | ≦ 0.015 |
| Selenium | ≦ 0.010 |

TABLE I

STATIC CLEANING OF IRON-NICKEL ALLOY COUPONS

| Test No. | Cleanliness | Metal Loss Wt. (mg/dm²/hr) | Corrosion Penetration (mils/yr) |
|---|---|---|---|
| 1 | Clean | 6 | 2.9 |
| 2 | " | 17 | 8.2 |
| 3 | " | 21 | 10.0 |
| 4 | " | 47 | 23.0 |
| 5 | Trace | 6 | 2.9 |
| 6 | " | 10 | 4.8 |
| 7 | " | 12 | 5.8 |
| 8 | Minor | 9 | 4.3 |
| 9 | Some | 11 | 5.1 |

| | COMPOSITION | | | |
|---|---|---|---|---|
| | Sulfamic | Citric | 2-butoxy ethanol | S'* |
| Test No. | Weight percent of aqueous solution | | | |
| 1 | — | 20 | — | — |
| 2 | 20 | 5 | — | 0.1 |
| 3 | 15 | — | — | 0.1 |
| 4 | 15 | 5 | — | 0.1 |
| 5 | 15 | — | — | 0.1 |
| 6 | 10 | 5 | 5 | 0.1 |
| 7 | — | 20 | 5 | 0.1 |
| 8 | 5 | 5 | 5 | 0.1 |
| 9 | — | 18 | 2 | 0.1 |

*S' = A surfactant which is a mixture of primary alcohols of about 10 to 12 member carbon chains, about 60% ethoxylated.

EXAMPLE 2

In this example dynamic cleaning tests were performed on the interior surface of an iron-nickel alloy pipe. The tests in this example were performed on the same iron-nickel alloy used in Example 1, which also had been contaminated with the same substances used in Example 1. A 12 inch length of 2 inch diameter pipe was subjected to a flow of the present cleaning solution. In each test the cleaning solution was conducted through the pipe at a rate of 5.5 ft./sec. for a period of 2 hours. This flow as flowed by a water flush for 0.17 hours at a rate of 3.5 ft./sec. The cleaning solution was at a temperature of between 66° and 74°F. with initial contaminations of varying amounts, the parameters of corrosion metal loss, corrosion penetration depth, and residual hydrocarbon amount were measured and a visual evaluation of the cleaning effectiveness was made. The results are tabulated in Table II.

TABLE II

DYNAMIC CLEANING OF IRON-NICKEL ALLOY PIPE

| particulate | Initial 66 mg. (triolein + mineral oil) + 1.0 ml. Hydrocarbon | Residual smut | Cleanliness visual observation weight | Metal Loss Penetration | Corrosion |
|---|---|---|---|---|---|

TABLE II-continued

| DYNAMIC CLEANING OF IRON-NICKEL ALLOY PIPE | | | | | |
|---|---|---|---|---|---|
| Test No. | solids | (mg.) | present | (mg/dm²/hr) | (mils/yr.) |
| 1 | 5300 | 1.6 | clean | 102 | 49 |
| 2 | 5800 | 1.7 | " | 45 | 22 |
| 3 | 4400 | 1.7 | " | 72 | 5.8 |
| 4 | 5700 | 2.0 | " | 69 | 33 |
| 5 | 3300 | 0.6 | rust | 20 | 9.7 |
| 6 | 4100 | 1.9 | " | 22 | 11 |
| 7 | 4700 | 2.6 | dirty | 44 | 22 |

| | COMPOSITION | | | |
|---|---|---|---|---|
| Test No. | Sulfamic | Citric | 2-butoxy ethanol | S '* |
| | Weight percent of aqueous solution | | | |
| 1 | 10 | 5 | 5 | 0.1 |
| 2 | 10 | 5 | 5 | 0.1 |
| 3 | — | 20 | 5 | 0.1 |
| 4 | 10 | 5 | 5 | 0.1 |
| 5 | — | 20 | — | 0.1 |
| 6 | — | 10 | 5 | 0.1 |
| 7 | 15 | 5 | — | 0.1 |

*S' herein is the same mixture as that defined by S' in Table 1.

What is claimed is:

1. A method of cleaning a metal surface which comprises the sequence of steps:

a. contacting said surface for a sufficient period of time to clean said surface with a composition comprising in percentages by weight the following ingredients:
   i. about 8 to 12% sulfamic acid;
   ii. about 4 to 6% citric acid;
   iii. about 4 to 6% of a nonionic solvent for hydrocarbon residues which solvent is characterized as not producing turbidity at 75°F when present in said composition;
   iv. about 0.095 to 0.15% of a soluble nonionic surfactant which surfactant is characterized as having a cloud point of at least about 90°F and having a surface tension of about 32 dynes/cm. or less when present in an amount of 0.1% of said composition;
   v. the balance, water;

b. rinsing said surface with water to remove residual composition; and c. passivating the surface with a solution of citric acid and sodium nitrite.

2. The method of claim 1 wherein the flow rate of the composition applied in step (*a*) is about 2 to about 30 feet per second.

3. The method of claim 1 wherein the temperature of the composition applied in step (*a*) is about 40°F to about 140°F.

4. The method of claim 1 wherein the temperature of the composition applied in step (*a*) is about 70°F to about 80°F.

5. The method of claim 1 wherein the surface is that of an iron-nickel alloy.

6. The method of claim 1 wherein the solvent is a glycol ether.

7. The method of claim 1 wherein the solvent is chosen from the group consisting of 2-butoxyethanol, 2-(2-butoxyethoxy)ethanol, 2-(2-ethoxyethoxy)ethanol, 2-methoxyethanol, and 2-ethoxyethanol.

8. The method of claim 1 wherein the surfactant is chosen from the group consisting of linear alcohol ethoxylates, polyoxyethylene esters, and alkyl aryl polyethylene oxides.

9. The method of claim 1 wherein the surfactant is a mixture of primary alcohols of about 10 to about 12 member carbon chains, about 60% ethoxylated.

10. A method of cleaning an iron-nickel alloy surface which comprises in sequence:

a. contacting said surface for a sufficient period of time to clean said surface with a composition comprising in percentages by weight the following ingredients:
   i. about 8 to 12% sulfamic acid;
   ii. about 4 to 6% citric acid;
   iii. about 4 to 6% of a nonionic solvent for hydrocarbon residues which solvent is characterized as not producing turbidity at 75°F when present in said composition;
   iv. about 0.095 to 0.15% of a soluble nonionic surfactant which surfactant is characterized as having a cloud point of at least about 90°F and having a surface tension of about 32 dynes/cm. or less when present in an amount of 0.1% of said composition;
   v. the balance, water; at a rate of 4 feet per second for a period of about 2 hours, said composition being maintained at a temperature of about 70°F to 80°F, b. contacting said surface with a 1% aqueous citric acid solution at a rate of 5.5 ft/sec for about 10 minutes, c. contacting said surface with a 0.1% aqueous sodium nitrite solution at a rate of 5.5 ft/sec for about 10 minutes to passivate said surface, and d. contacting said surface with water at a rate of 3.5 ft/sec for about 20 minutes to remove residual substances.

* * * * *

UNITED STATES PATENT OFFICE

CERTIFICATE OF CORRECTION

PATENT NO. : 3,957,529

DATED : May 18, 1976

INVENTOR(S) : George B. Alexander; Norman F. Carpenter

It is certified that error appears in the above-identified patent and that said Letters Patent are hereby corrected as shown below:

Col. 2, line 9, after "8" change "to" to --and--;
Col. 2, line 11, after "4" change "to" to --and--;

Col. 4, Table II, first column, change "66" to --concentration--;
Col. 4, Table II, last entry, each column, move to right under previous entry;

Signed and Sealed this

Twenty-third Day of November 1976

[SEAL]

*Attest:*

RUTH C. MASON
*Attesting Officer*

C. MARSHALL DANN
*Commissioner of Patents and Trademarks*